United States Patent [19]

Kasai

[11] 4,112,554

[45] Sep. 12, 1978

[54] SEPARABLE SLIDE FASTENER WITH AN AUTOMATICALLY LOCKING SLIDER

[75] Inventor: Kazumi Kasai, Namerikawa, Japan

[73] Assignee: Yoshida Kogyo K.K., Japan

[21] Appl. No.: 839,438

[22] Filed: Oct. 5, 1977

[30] Foreign Application Priority Data

Oct. 13, 1976 [JP] Japan ..... 51-137352[U]

[51] Int. Cl.[2] ..... A44B 19/36; A44B 19/30

[52] U.S. Cl. ..... 24/205.11 R; 24/205.14 R

[58] Field of Search ..... 24/205.11 R

[56] References Cited

U.S. PATENT DOCUMENTS 3,858,283 1/1975 Runnels ..... 24/205.14 R

*Primary Examiner*—Bernard A. Gelak

*Attorney, Agent, or Firm*—Bucknam and Archer

[57] ABSTRACT

A slide fastener comprising a box-and-pin separable coupling and an automatically locking slider. The slider has a locking member pivoted at one end on the slider body and having first and second legs formed adjacent its other end in side-by-side disposition. The first leg of the locking member is normally spring-biased into a position of interference with the pin-side row of fastener elements when the slider is riding on both rows of fastener elements, and the second leg is disposed opposite to the box-side row of fastener elements. When the slider is moved into abutting contact with the box member of the separable coupling, the second leg of the locking member rides onto a protuberance formed on the guide bar of the box member, so that the first leg of the locking member is retracted from its interference position against the bias of the spring to permit smooth insertion of the pin member of the separable coupling into the box member through the slider.

5 Claims, 6 Drawing Figures

SEPARABLE SLIDE FASTENER WITH AN AUTOMATICALLY LOCKING SLIDER

BACKGROUND OF THE INVENTION

1. Field of the Invention

This invention relates to slide fasteners, and in particular to improvements in a separable slide fastener of the type comprising a box-and-pin separable coupling and an automatically locking slider.

2. Description of the Prior Art

A slide fastener has been known and used extensively which incorporates an automatically locking slider with a pair of fastener stringers having a box-and-pin separable coupling designed to permit ready connection and disconnection of the stringers. In such a separable slide fastener, the slider rides on the box-side row of fastener elements or scoops when the fastener is separated, and the fastener stringers can be connected together as the pin member of the separable coupling is inserted into the box member through the slider held in abutting contact therewith. It has also been known to spring-bias the locking member or pawl of the slider into a position of interference engagement with only the box- or the pin-side row of fastener elements. The slider of either type has its own advantages and disadvantages.

An automatically locking slider with its locking member spring-biased into a position of interference with the pin-side row of fastener elements, for example, is free to move in either direction along the box-side row of fastener elements when the fastener is separated. A difficulty arises, however, in connecting the pair of fastener stringers, since the locking member hampers the insertion of the pin member into the box member through the slider.

The above disadvantage is totally absent from a slider having its locking member urged into interference engagement with the box-side row of fastener elements. A difficulty is also encountered with this type of slider, however, in the case where the slider is locked in a position away from the box member when the fastener is separated. The slider is then not smoothly movable into contact with the box member unless its pull tab is properly manipulated to unlock the slider and hold same unlocked during its movement into contact with the box member.

SUMMARY OF THE INVENTION

It is an object of this invention to provide an improved separable slide fastener comprising both box-and-pin separable coupling and automatically locking slider, so made that the pin member of the separable coupling can be smoothly inserted into the box member through the slider for connecting the pair of fastener stringers.

Another object of the invention is to provide a separable slide fastener of the type defined which permits free movement of the automatically locking slider along the box-side row of fastener elements when the pair of fastener stringers are diconnected.

A further object of the invention is to provide a separable slide fastener of the type defined, so made that following the insertion of the pin member into the box member, the slider can be readily moved away from the separable coupling for closing the fastener.

Briefly, a separable slide fastener in accordance with this invention includes an automatically locking slider having a locking member pivotally mounted at one end on the slider body. The locking member has first and second legs formed at or adjacent its other end. The first leg of the locking member is normally biased by spring means into a position of interference with the pin-side row of fastener elements when the slider is riding on both rows of fastener elements, whereas the second leg is normally biased by the spring means toward the box-side row of fastener elements but is held out of contact therewith. The separable slide fastener further comprises means on the box member of the separable coupling for retracting the first leg of the locking member away from its interference position by engaging the second leg and causing the latter to move against the bias of the spring means when the slider is moved into abutting contact with the box member.

In a preferred embodiment, the second leg of the locking member rides onto a protuberance on the guide bar of the box member when the slider is moved into abutting contact therewith, with the consequent retraction of the first leg away from its interference position against the bias of the spring means. The pin member of the separable coupling can therefore be smoothly inserted into the box member through the slider held in abutting contact therewith, without being impeded by the first leg of the locking member. Following the insertion of the pin member into the box member, the slider can be readily moved away from the separable coupling to close the fastener, since the first leg of the locking member has been held retracted merely by causing its second leg to ride over the protuberance on the guide bar of the box member. Furthermore, since the locking member is engageable only with the pin-side row of fastener elements, the slider is free to move in either direction along the box-side row of fastener elements when the fastener is separated.

The above and other objects, features and advantages of this invention and the manner of attaining them will become more readily apparent, and the invention itself will best be understood, from the following description and appended claims taken together with the accompanying drawings showing preferred embodiments of the invention.

DESCRIPTION OF THE PREFERRED EMBODIMENTS

Figure 1:
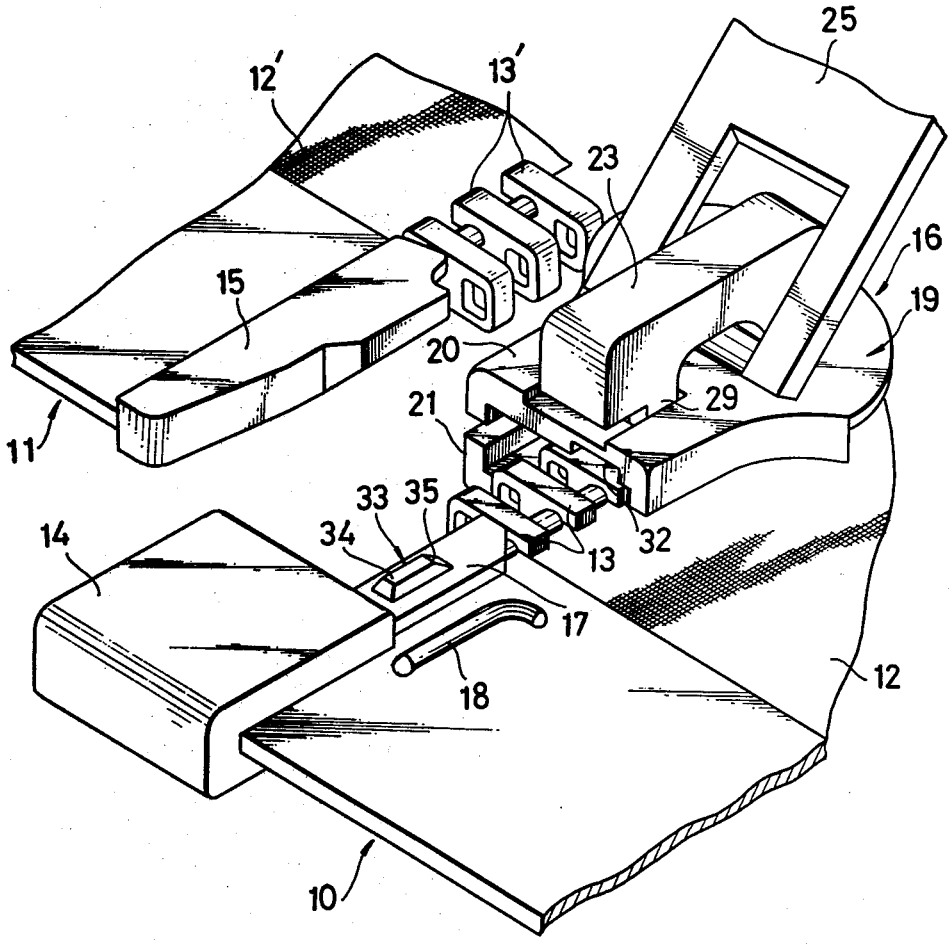
FIG. 1 is a partial perspective view of the separable slide fastener embodying this invention, the view showing the pair of fastener stringers desconnected and the automatically locking slider moved away from the box member of the box-and-pin separable coupling.

With reference first and in particular to FIG. 1 of the drawings, the illustrated form of the separable slide fastener in accordance with this invention comprises a pair of stringers 10 and 11 which include stringer tapes 12 and 12' and rows of fastener elements or scoops 13 and 13' affixed respectively to the confronting longitudinal edges of the stringer tapes. The separable slide fastener further comprises a box-and-pin separable coupling having a box member 14 attached to the stringer tape 12 and a pin member 15 attached to the other stringer tape 12' for connecting and disconnecting these stringer tapes, and an automatically locking slider 16 riding on the box-side row of fastener elements 13 when the stringer tapes are disconnected as shown in FIG. 1.

The rows of fastener elements 13 and 13' are shown to be of the discrete type individually clamped onto the respective beaded or reinforced edges of the stringer tapes 12 and 12' in accordance with the prior art. These rows of fastener elements are of course to be coupled with or uncoupled from each other by the slider 16 as the latter is moved therealong for closing or opening the fastener.

The box member 14 of the box-and-pin separable coupling is secured to the fastener element-carrying edge of the stringer tape 12 under the row of fastener elements 13 thereon, whereas the pin member 15 is secured to the fastener element-carrying edge of the other stringer tape 12' just under the row of fastener elements 13' thereon. The box member 14 defines the usual pin socket, not seen in the drawings, for receiving the pin member 15 as the latter is inserted endwise therein through the slider 16 held in abutting contact with the box member, to connect the pair of stringer tapes 12 and 12'.

Formed integral with the box member 14 is a guide bar 17 which extends upwardly therefrom to the endmost one of the fastener elements 13 on the stringer tape 12. This guide bar is to be inserted into the slider 16 when the latter is moved into abutting contact with the box member 14. A guide ridge 18 is formed on the stringer tape 12 alongside the guide bar 17, and this guide ridge is intended to coact with the guide bar 17 to hold the slider 16 in exact alignment with the box member 14 when the slider is moved into abutting contact wherewith and thus to facilitate the insertion of the pin member 15 into the box member 14 through the slider.

The automatically locking slider 16 is movable along the box-side row of fastener elements 13 when the stringer tapes 12 and 12' are disconnected as shown in FIG. 1, and along both rows of fastener elements 13 and 13' for coupling and uncoupling same when the stringer tapes are connected by the box-and-pin separable coupling.

Figure 2:
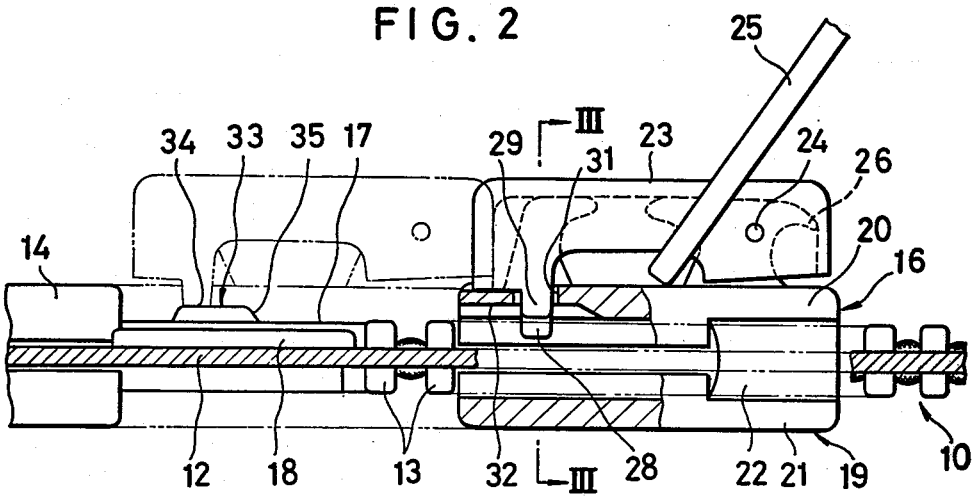
FIG. 2 is a partial side elevational view, partly sectioned and partly broken away for clarity, of the slider and the box-side stringer of the slide fastener of FIG. 1.
Figure 3:
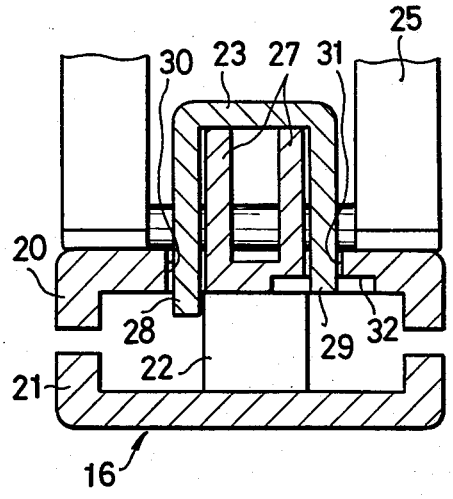
FIG. 3 is an enlarged sectional view taken along the line III—III of FIG. 2 and showing in particular the locking member of the slider in its normal position.

As will be seen also from FIGS. 2 and 3, the automatically locking slider 16 has a body 19 comprising front and rear wings or plate members 20 and 21 and a neck 22 integrally connecting the wings at their upper ends to provide the usual Y-shaped guide channel in the slider body for the rows of fastener elements 13 and 13'. The automatic lock mechanism of the slider 16 includes a locking member 23 pivoted at its upper end by a pin 24 on the front wing 20 of the slider body 19. The locking member 23 is in the shape of an inverted U, and a pull tab 25 is pivotally and slidably connected thereto for unlocking the slider and manipulating same in the known manner.

A spring 26 biases the locking member 23 to turn in a counterclockwise direction, as viewed in FIG. 2, about the pivot pin 24, and the counterclockwise turn of the locking member is limited in the normal position shown in FIGS. 1 through 3 by stop means including a pair of upstanding stop walls 27 on the front wing 20 of the slider body 19. At or adjacent its lower, free end the locking member 23 has first and second legs 28 and 29 formed in side-by-side disposition with a spacing therebetween. Under the bias of the spring 26, these legs 28 and 29 of the locking member project with clearance into a pair of laterally spaced openings 30 and 31, respectively, that are formed in the front wing 20 of the slider body 19.

It will be observed from FIG. 3 that the first leg 28 of the locking member 23 is longer than its second leg 29. Normally, this first leg projects into the guide channel in the slider body 19 through the opening 30 under the bias of the spring 26, for interference contact with the pin-side row of fastener elements 13' when the slider 16 is riding on both rows of fastener elements. The first leg 28 of the locking member 23 is thus adapted to lock the slider 16 against movement in either direction when the slider is riding on both rows of fastener elements 13 and 13' and there is no pull on the pull tab 25.

The shorter second leg 29 of the locking member 23 normally projects through the opening 31 into a groove 32 formed in the inside surface of the slider body front wing 20 and extending upwardly from its lower end, and the end of the second leg 29 is normally disposed in coplanar relationship to the inside surface of the front wing. The second leg 29 of the locking member 23 is thus biased by the spring 26 toward the box-side row of fastener elements 13 but is restrained from locking engagement therewith. The groove 32 has a depth approximately equal to the length of that portion of the first leg 28 of the locking member 23 which normally projects into the guide channel in the slider body 19, and in this particular embodiment, the groove has a constant width throughout its length.

Figure 4:
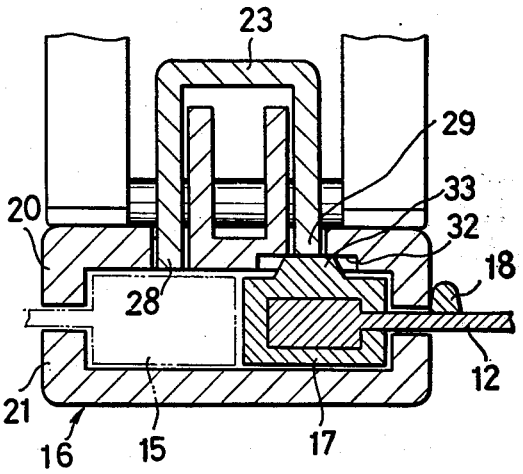
FIG. 4 is a view similar to FIG. 3 but showing the first leg of the locking member retracted from its position of interference with the pin-side row of fastener elements upon movement of the slider into abutting contact with the box member of the separable coupling.

FIGS. 1, 2 and 4 show a protuberance 33 formed integral with and projecting forwardly from the guide bar 17 of the box member 14 so as to be received in the groove 32 in the inside surface of the slider body front wing 20 when the guide bar is inserted endwise into the slider body upon movement of the slider 16 into abutting contact with the box member 14. The protuberance 33 has a flat front surface 34 and a sloping upper surface 35, so formed that when the guide bar 17 is inserted fully into the slider body 19, the second leg 29 of the locking member 23 will ride onto the front surface 34 of the protuberance via its sloping upper surface 35. It will be seen from FIG. 4 that the protuberance 33 has a width considerably less than the width of the groove 32 and a height sufficient to cause retraction of the first leg 28 of the locking member 23 from the guide channel in the slider body 19 when its second leg 29 rides on the fron surface 34 of the protuberance.

Thus, for connecting the pair of stringer tapes 12 and 12', the slider 16 is moved into abutting contact with the box member 14, as indicated by the dot-and-dash lines in FIG. 2. The guide bar 17 of the box member 14 is then received in the slider 16, and the second leg 29 of the locking member 23 rides onto the front surface 34 of the protuberance 33 via its upper surface 35, resulting in the clockwise turn of the locking member about its pivot pin 24 against the bias of the spring 26. As a consequence, the first leg 28 of the locking member 23 is retracted away from its position of interference with the pin-side row of fastener elements 13', so that the pin member 15 can be inserted into the box member 14 through the slider 16 without being impeded by the first leg of the locking member, as will be evident from FIG. 4.

The slide fastener can be closed as the slider 16 is then moved upwardly along the rows of fastener elements 13 and 13' by manipulating the pull tab 25. As is well known, the automatic lock mechanism of the slider 16 functions to lock the slider against movement in a desired position on the rows of fastener elements 13 and 13' and to permit the slider to be unlocked upon exertion of a pull on the pull tab 25.

Figure 5:
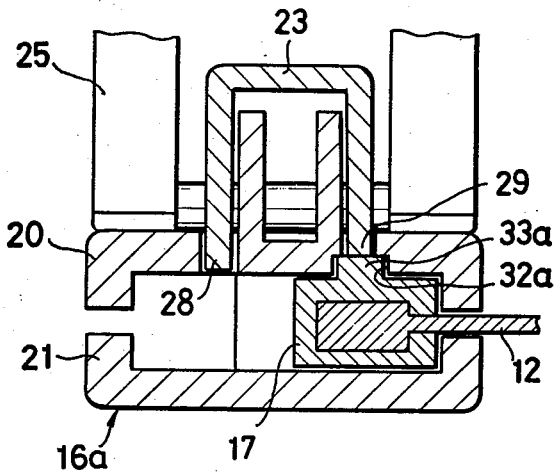
FIG. 5 is a view similar to FIG. 4 but showing a slight modification of the embodiment of FIGS. 1 through 4.
Figure 6:
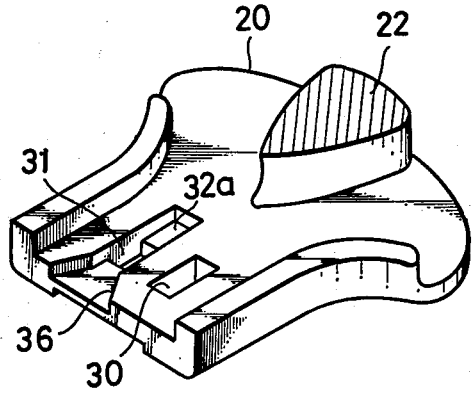
FIG. 6 is a partial perspective view of the slider of FIG. 5, the view showing the front wing of the slider body in upside-down disposition, with its rear wing cut off, to clearly reveal the inside surface of the front wing.

Illustrated in FIGS. 5 and 6 is a slight modification of the preceding embodiment, which modification includes a slider **16*a* having a groove 32*a* of reduced width sufficient to relatively closely receive a protuberance 33*a* on the guide bar 17 of the box member 14. The groove 32*a* has a flared entrance end 36 such that the protuberance 33*a* can be readily guided into the groove as the slider 16*a* is moved into abutting contact with the box member 14. It is possible in this manner to guide the slider 16*a* into a position of proper alignment with the box member 14 when the slider is moved into abutting contact therewith. The other details of construction of this modified slide fastener are substantially as set forth above in connection with FIGS. 1 through 4**, and its operation and advantages are also believed to be apparent from the foregoing.

Although the improved separable slide fastener in accordance with this invention has been shown and described in terms of its preferable forms, it is understood that such detailed disclosure is by way of example only and is not to impose limitations upon the invention. Various modifications and variations will readily occur to those skilled in the art without departing from the spirit or scope of the appended claims.

What is claimed is:

1. A separable slide fastener comprising, in combination:

(a) a pair of complementary stringer tapes;

(b) rows of interlocking fastener elements affixed respectively to the confronting longitudinal edges of the stringer tapes;

(c) separable coupling means for connecting and disconnecting the stringer tapes, the separable coupling means comprising:

(1) a pin member secured to the fastener element-carrying edge of one of the stringer tapes under the row of fastener elements thereon; and (2) a box member secured to the fastener element-carrying edge of the other stringer tape under the row of fastener elements thereon, the box member being adapted to receive the pin member when the stringer tapes are connected;

(d) an automatically locking slider movable along both rows of fastener elements for coupling and uncoupling same when the stringer tapes are connected by the separable coupling means, and along the row of fastener elements associated with the box member when the stringer tapes are disconnected, the slider comprising:

(1) a body defining therein a guide channel for the rows of fastener elements;

(2) spring means; and (3) a locking member pivotally supported at one end on the slider body and having first and second legs formed adjacent its other end, the first leg of the locking member being normally biased by the spring means into a position of interference with the row of fastener elements associated with the pin member when the slider is riding on both rows of fastener elements, the second leg of the locking member being normally biased by the spring means toward the row of fastener elements associated with the box member and being restrained from locking engagement therewith; and (e) means on the box member of the separable coupling means for retracting the first leg of the locking member away from its interference position by engaging the second leg of the locking member and causing the latter to move against the bias of the spring means when the slider is moved into abutting contact with the box member;

(f) whereby the pin member of the separable coupling means can be smoothly inserted into the box member thereof through the slider for connecting the pair of stringer tapes while the slider is held in abutting contact with the box member.

2. A separable slide fastener according to claim 1, wherein the body of the slider includes front and rear wings, the front wing of the slider body having a pair of laterally spaced openings formed therein, and wherein the first and the second legs of the locking member are disposed in side-by-side relationship to each other and normally extend into and through the respective openings in the front wing of the slider body under the bias of the spring means.

3. A separable slide fastener according to claim 2, wherein the box member of the separable coupling means has a guide bar extending upwardly therefrom so as to be received in the slider when the latter is moved into abutting contact with the box member, and wherein the retracting means includes a protuberance formed on the guide bar of the box member.

4. A separable slide fastener according to claim 3, wherein the front wing of the slider body has formed in its inside surface a groove in communication with that one of the openings through which extends the second leg of the locking member, the groove being adapted to receive the protuberance on the guide bar of the box member when the slider is moved into abutting contact with the box member, and wherein the second leg of the locking member normally has its end disposed in substantially coplanar relationship to the inside surface of the front wing of the slider body.

5. A separable slide fastener according to claim 4, wherein the groove in the front wing of the slider body has a flared entrance end to facilitate the entry of the protuberance on the guide bar of the box member into the groove.

* * * * *